US005378850A

United States Patent [19]

Tumura

[11] Patent Number: 5,378,850

[45] Date of Patent: Jan. 3, 1995

[54] ELECTRIC STRINGED INSTRUMENT HAVING AN ARRANGEMENT FOR ADJUSTING THE GENERATION OF MAGNETIC FEEDBACK

[75] Inventor: Kenji Tumura, Osaka, Japan

[73] Assignee: Fernandes Co., Ltd., Tokyo, Japan

[21] Appl. No.: 3,418

[22] Filed: Jan. 12, 1993

[30] Foreign Application Priority Data

Jan. 14, 1992 [JP] Japan ..... 4-005054

[51] Int. Cl.[6] ..... G10H 1/057; G10H 3/18

[52] U.S. Cl. ..... 84/727; 84/728; 84/735; 84/738; 84/DIG. 10

[58] Field of Search ..... 84/726–728, 84/DIG. 10, 738, 735, 736

[56] References Cited

U.S. PATENT DOCUMENTS 2,894,491 7/1959 Hecht .
4,941,388 7/1990 Hoover et al. .

FOREIGN PATENT DOCUMENTS 53-139836 12/1977 Japan .
52-151022 12/1977 Japan .
55-152597 12/1979 Japan .

*Primary Examiner*—Stanley J. Witkowski
*Attorney, Agent, or Firm*—Finnegan, Henderson, Farabow, Garrett & Dunner

[57] ABSTRACT

An electric stringed instrument comprises an electromagnetic pickup having a permanent magnet and a string signal detecting coil wound around the permanent magnet and magnetically combined with the permanent magnet, an electromagnetic force producing unit having a driving coil to produce a magnetic force and being placed in the neighborhood of the electromagnetic pickup, and an adjusting unit provided with a part of a current flowing in the driving coil of the electromagnetic force producing unit and disposed at a place magnetically combined with the string signal detecting coil of the electromagnetic pickup. One induced electromotive force caused by magnetic flux from the adjusting unit and another induced electromotive force caused by magnetic flux from the electromagnetic force producing unit negate each other in the string signal detecting coil.

19 Claims, 8 Drawing Sheets

ELECTRIC STRINGED INSTRUMENT HAVING AN ARRANGEMENT FOR ADJUSTING THE GENERATION OF MAGNETIC FEEDBACK

BACKGROUND OF THE INVENTION

1. Field of the Invention

The present invention relates to an electric stringed instrument, e.g., an electric guitar or an electric piano, and more particularly to an electric stringed instrument having an electromagnetic force producing unit, e.g., an electromagnetic driver for sustaining the vibration of a string or a loudspeaker for outputting an amplified sound converted from an electrical signal produced by the vibration of a string, and further substantially causing no high frequency noise produced by so-called "magnetic feedback".

2. Description of the Prior Art

Generally, an electric stringed instrument, e.g., an electric guitar or an electric piano, has plural strings and a transducer, i.e., a pickup for converting the vibration of a string to an electrical signal. There are two well-known types of pickups. One is an electromagnetic type of pickup and the other is a piezoelectric type of pickup. Particularly, in a case of an electric guitar, the electromagnetic type of pickup has been used since the introduction of electric guitars, because by using the electromagnetic type of pickup it is easy to obtain a sound characteristic that emphasizes a medium sound region, by mounting the electromagnetic type of pickup on a body of an electric guitar and processing the resultant electrical signal.

In recent years, an attempt to use an electromagnetic transducer for exciting a string has been made and has actually been put into practice. This transducer utilizes an inverse principle of operation of an electromagnetic pickup which converts the vibration of a string to an electrical signal. Namely, an electrical signal detected by a pickup is amplified by an amplifier, and the amplified signal is applied to an electromagnetic driver, and thereby the electromagnetic driver emits magnetic energy to a string. By the magnetic energy emitted from the electromagnetic driver the string is self-excited, and thereby the vibration of the string is sustained for a long time.

However, in order to excite a string through an electromagnetic driver, the electromagnetic driver, i.e., an electromagnetic force producing unit, must emit a strong magnetic force in the vicinity of the string. Therefore, there is a problem that the magnetic field generated by the electromagnetic driver causes a so-called magnetic feedback which is introduced by a leakage of flux fed back from the electromagnetic driver to an electromagnetic pickup. The magnetic feedback causes an induced electromotive force of no use in the electromagnetic pickup, and thereby causes noise, e.g., an oscillation in a frequency range from about 1,000 Hz to 20,000 Hz.

Several prior arts disclose devices for reducing the magnetic feedback described above and sustaining the vibration of a string in relation to an electric stringed instrument. For example, Japanese Patent Publication No. 52-151022 and Japanese Utility Model Publication No. 53-139836 (Both filed by Roland Ltd.) disclose an electric guitar in which the strings of the guitar are connected to an electrical driving circuit mounted within the guitar, and when detecting the vibration of the strings at a pickup on the guitar, a positive feedback current output from the circuit flows through the strings as a part of the circuit, and so the strings in which the positive feedback current is flowing vibrate in cooperation with a magnet attached to a surface of the guitar. This type of guitar does not use an electromagnetic driver that converts an electrical signal detected by a pickup into a magnetic driving force utilizing a variation of magnetic flux corresponding to the signal and drives the metal string by the driving force. Thus, this type of guitar has the advantage of not generating the magnetic feedback described above. However, the guitar requires an external power supply to provide power for the self-driving strings, and further it must have a strong magnet to drive the strings in which the positive feedback current flows. The system also becomes large since the strings must be connected to the circuit. Therefore, the type of electric guitar described above needs to be designed as an exclusive instrument, and consequentially it is not practical to manufacture it on a commercial basis.

Another disclosure is described in Japanese Utility Model Publication No. 55-152597 (YAMAHA Ltd.). Although there is no description of magnetic feedback described above, a pickup shown in the specification and the drawings uses a light-emitting element and a light-intercepting element, and thus, there is no need to consider the magnetic feedback described above. However, this type of electric guitar does not use an electromagnetic pickup as described above so that a tone generated from this guitar is different from the tone of an electric guitar having a commonly used electromagnetic pickup.

Furthermore, U.S. Pat. No. 4,941,388 (Hoover, et al.) discloses a constitution that has an electromagnetic pickup and an electromagnetic driver in order to sustain the vibration of strings of an electric guitar without using the arrangement described above. In this constitution, an unbalancing device for putting a magnetic balance between the electromagnetic pickup and the electromagnetic driver out of balance is used to reduce the magnetic feedback described above, and as a particularly effective method, an embodiment using a shunting plate is disclosed. An electric guitar having a device for reducing the magnetic feedback by using the shunting plate is put into practical use and a device by the name of "Sustaniac" is available on the market. However, even if the shunting plate is used, a part of the magnetic feedback that cannot be completely absorbed into the shunting plate remains. In order to reduce the magnetic flux from the electromagnetic driver to the electromagnetic pickup as much as possible, the design of the shunting plate is greatly limited to precisely match the shunting plate to magnetic characteristics and winding orientation of pole pieces of the electromagnetic pickup and the electromagnetic driver, and further in this type of guitar using the shunting plate, only a humbucking type of pickup can be utilized.

Furthermore, in recent years an electric stringed instrument having an amplifier and a loudspeaker in a body thereof has been proposed. In the electric stringed instrument described above, the vibration of a string is converted to an electric signal by an electromagnetic pickup, and the electric signal is amplified by an amplifier and then the amplified signal is output as a guitar sound from a loudspeaker. Since this type of electric stringed instrument that has an amplifier and a loudspeaker in its body can output enough sound level without using an external amplifier, it is very portable in that it can be played anywhere. Therefore, the electric stringed instrument described above is very convenient for playing music or enjoying the sound of the instrument easily. However, in such an application of the electric stringed instrument to an electric guitar, a distance between a loudspeaker and an electromagnetic pickup in a guitar body must be short because of a limited absolute size of the guitar body, and magnetic flux emitted from a voice coil of the loudspeaker in use easily penetrates the electromagnetic pickup as well as a leakage flux emitted from an electromagnetic driver described above, and thereby the magnetic feedback described above is caused so that a sound output from the loudspeaker involves a high frequency noise as described above.

SUMMARY OF THE INVENTION

The purpose of the present invention is to provide an electric stringed instrument that solves such problems as described above and prevents a generation of noise due to the magnetic feedback described above even if arranging an electromagnetic driver or a loudspeaker as an electromagnetic force producing unit in the neighborhood of an electromagnetic pickup.

According to the present invention an electric stringed instrument comprises an electromagnetic pickup having a permanent magnet and a string signal detecting coil wound around the permanent magnet and magnetically combined with the permanent magnet, an electromagnetic force producing means having a driving coil to produce magnetic force and being placed in the neighborhood of the electromagnetic pickup, and an adjusting means provided with a part of a current flowing in the driving coil of the electromagnetic force producing means and disposed at a place magnetically combined with the string signal detecting coil of the electromagnetic pickup.

In the electric stringed instrument described above according to the present invention, one induced electromotive force caused by magnetic flux from the adjusting means and another induced electromotive forces caused by magnetic flux from the driving coil negate each other in the string signal detecting coil. Also, according to the present invention, the adjusting means alters a tone color output from the electric stringed instrument by causing induced electromotive forces to be produced by the adjusting means in the string signal detecting coil.

Further, in the electric stringed instrument described above according to the present invention, the electromagnetic force producing means is an electromagnetic driver for sustaining the vibration of a string or a loudspeaker for outputting an amplified sound through an amplifier that amplifies an output signal from the electromagnetic pickup. Also, the adjusting means is placed at a peripheral portion or an inside boundary portion or an inner portion of the string signal detecting coil wound in the shape of concentric circles.

Also, in the electric stringed instrument described above according to the present invention, the adjusting means is an adjusting wire that is a nearly straight-line conductive wire placed in the neighborhood of the string signal detecting coil, or a thin-film conductor having a conductive unit on a base unit formed on a film, and a conductive grounding unit placed between the base unit and the string signal detecting coil.

Furthermore, in the electric stringed instrument described above according to the present invention, the adjusting means is attached to, e.g., a cover of the string signal detecting coil, a bobbin of the string signal detecting coil, a fixture of the electromagnetic pickup, a body of the electric stringed instrument or a pick-guard placed in the neighborhood of the electromagnetic pickup.

BRIEF DESCRIPTION OF THE DRAWINGS

The present invention will be more clearly understood from the description as set forth below with reference to the accompanying drawings.

DESCRIPTION OF THE PREFERRED EMBODIMENTS

Figure 1:
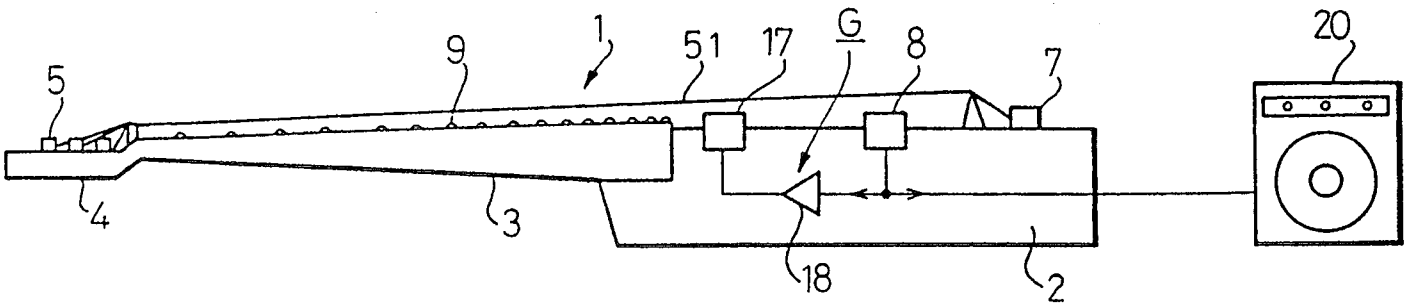
FIG. 1 is a general schematic arrangement of an electric guitar having a device for sustaining the vibration of strings.
Figure 2A:
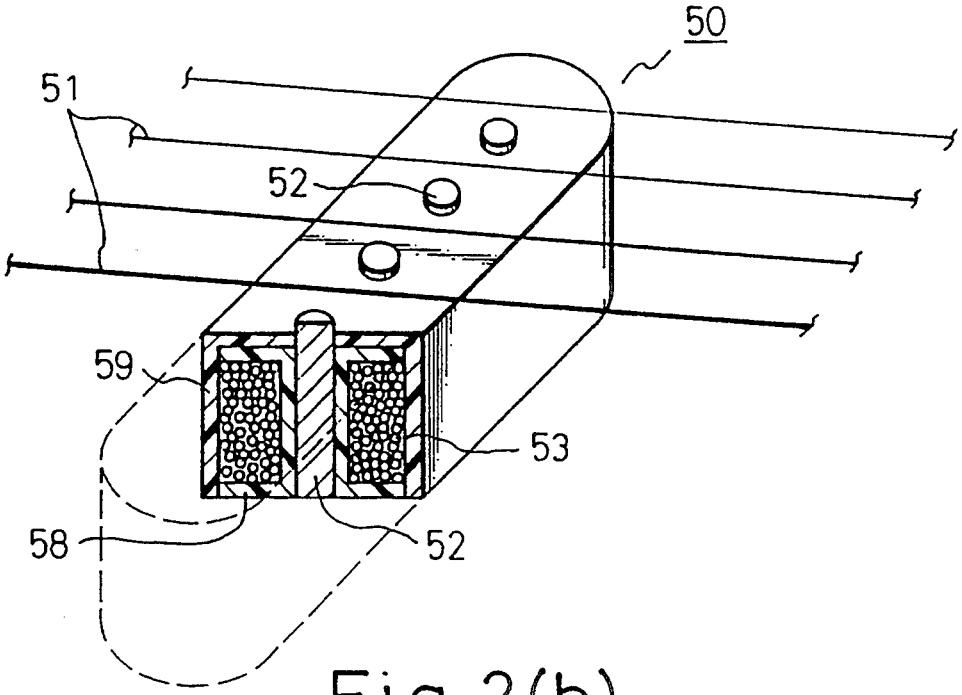
FIG. 2(*a*) and FIG. 2(*b*) are cross-sectional views of two types of electromagnetic pickups; one is a so-called single coil type pickup in FIG. 2(*a*) and the other is a so-called double coil type pickup in FIG. 2(*b*).
Figure 2B:
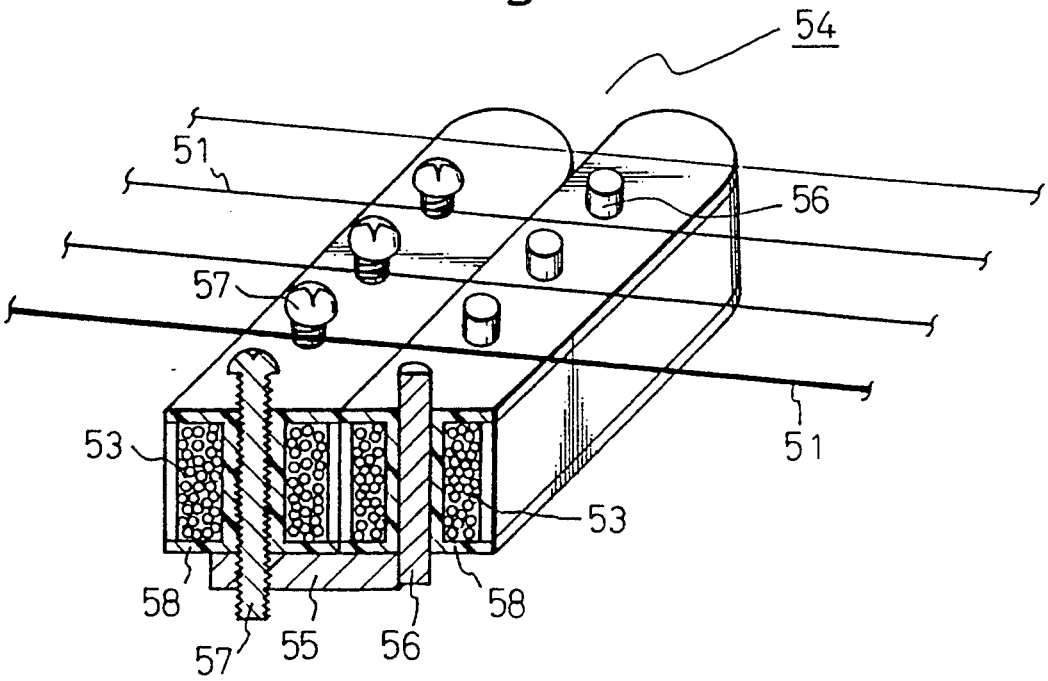

Before describing the preferred embodiments according to the present invention, examples of the related art are provided with reference to accompanying drawings (FIG. 1 and FIG. 2(*a*), (*b*)).

FIG. 1 shows an electric guitar that has a so-called "sustainer" G for sustaining the vibration of a string 51. In FIG. 1, an electric guitar 1 has a body 2 and a neck 3 combined with the body 2. Frets 9 are placed side by side on the surface of the neck 3 and a head 4 is shaped at an elongated end portion of the neck 3. A plurality of pegs 5 (string winders) are attached to the head 4 and each peg 5 has a structure for winding up one end of the string 51 made of a metal conductive wire. The other end of the string 51 is fixed at a tailpiece 7 attached to the surface of the body 2. Reference numeral 8 is an electromagnetic pickup. There are two types of typical pickups 8 as shown in FIG. 2(*a*) and FIG. 2(*b*).

FIG. 2(*a*) is a so-called single coil type pickup 50 that comprises a plurality of pole pieces 52 made of a cylindrical magnetic body, i.e., a permanent magnet respectively disposed corresponding to each string 51, a coil 53 wound around the pole pieces 52, a bobbin 58 with the coil 53 wound therearound and a cover 59. However, the constitution described above is nearly the same as that of an antenna so that there is a defect that the single coil type pickup 50 easily detects induced extraneous noise in addition to a single of the vibration of a string 51. To solve the detect described above, a hum-bucking type electromagnetic pickup disclosed in U.S. Pat. No. 2,894,491 is proposed by Seth E. Lover.

FIG. 2(*b*) is a so-called double coil type pickup or a hum-bucking pickup 54 that is basically formed with a parallel arrangement of two single coil type of pickups 50 and comprises plural pairs of pole pieces 56, 57 respectively disposed corresponding to each string 51, which are made of a pair of magnetic bodies 56, 57, i.e., a ferromagnetic material, so as to emit magnetic flux to each string 51 by using a single permanent magnet 55 combined magnetically with each pole piece 56, 57, coils 53 respectively wound around each pole piece 56, 57, bobbins 58 and covers 59. In FIG. 2(*b*), the pole pieces 57 are formed in the shape of a screw so as to enable adjustment of the sensitivity of detection of the vibration of each string 51.

An outline of the principle of operation of an electromagnetic pickup 8 (50, 54) as described above is as follows. The vibration of a conductive metal string 51 in the magnetic field formed by a permanent magnet 52 or 55 causes a change in magnetic reluctance in the neighborhood of the electromagnetic pickup 8, and thereby the magnetic flux density inside of the circumference of the coil 53 varies in response to the vibration of the string 51 so that an electric signal as induced electromotive force is produced in the electromagnetic pickup 8.

Again in FIG. 1, a signal detected at the electromagnetic pickup 8 is applied to a guitar amplifier 20 and the guitar amplifier 20 outputs a sound. On the other hand, the signal detected in the electromagnetic pickup 8 is also applied to a sustainer G. The sustainer G comprises the electromagnetic pickup 8, an amplifier 18 and an electromagnetic driver 17. A signal of the vibration of a string 51 detected at the electromagnetic pickup 8 is applied to the amplifier 18 within the guitar body 2 and the amplified signal is applied to an electromagnetic driver 17. The electromagnetic driver 17 basically uses the inverse of the principle of the electromagnetic pickup 8 as described above. The electric signal detected at the electromagnetic pickup 8 is amplified by the amplifier 18, and provided to the electromagnetic driver 17 which has the same structure as the electromagnetic pickup 8 shown in FIG. 2(*a*) or FIG. 2(*b*), and the electromagnetic driver 17 causes the string 51 to maintain the vibration of the string 51 by providing the flux emitted from the electromagnetic driver 17. Incidentally, the coil portion of the electromagnetic driver 17 is not the same as the electromagnetic pickup 8 because the electromagnetic driver 17 requires a lot of power to emit enough magnetic flux to excite a string 51. Accordingly the coil of the electromagnetic driver 17 uses a copper wire with a diameter 0.3 mm which is larger than that used in the electromagnetic pickup 8 and the wire is wound for about 200 turns. Therefore, the electromagnetic driver 17 has little electrical resistance, about 7 ohms, and low power-loss characteristics.

However, as described above there is a problem that magnetic feedback is produced in the arrangement described above.

Figure 3:
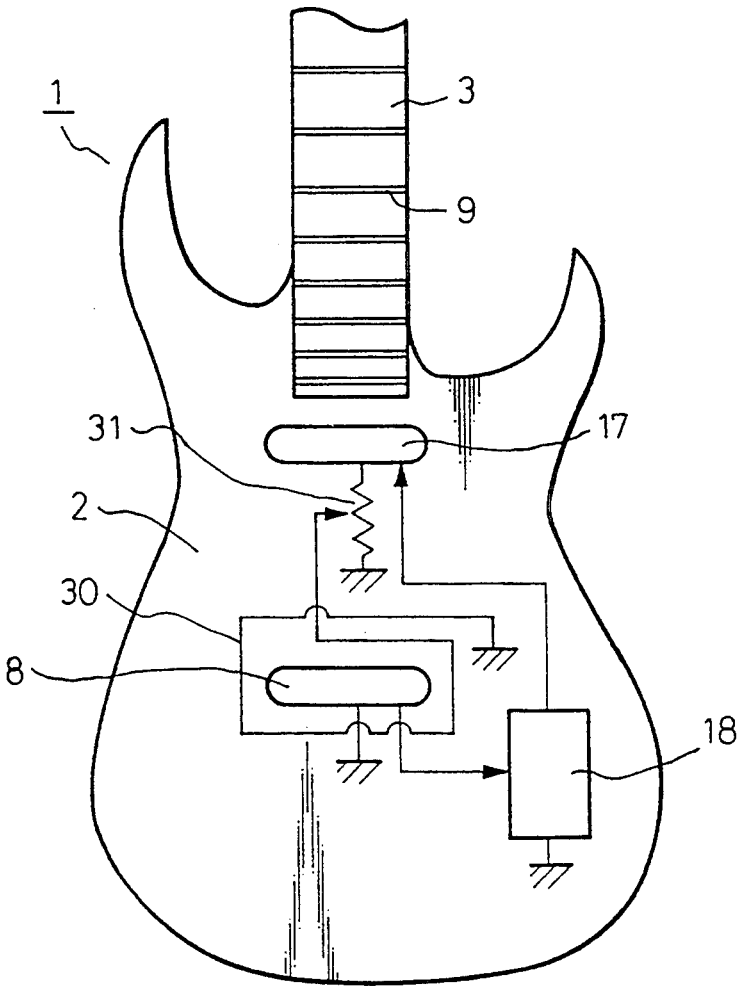
FIG. 3 is a schematic view of a basic constitution of an electric guitar according to the present invention.

FIG. 3 shows a schematic view of a basic constitution of an electric guitar according to the present invention.

In FIG. 3, an electric stringed instrument, i.e., an electric guitar 1, according to the present invention has an electromagnetic pickup 8 formed with a permanent magnet and a string signal detecting coil wound around the permanent magnet and magnetically combined with the permanent magnet, and an electromagnetic driver 17 placed in the neighborhood of the electromagnetic pickup 8, that is an electromagnetic force producing unit, for sustaining the vibration of a string. Further, in the electric guitar 1 and adjusting unit, e.g., an adjusting coil 30 in FIG. 3, provided with a part of a current flowing in a driving coil of the electromagnetic force producing unit is disposed at a place magnetically combined with a string signal detecting coil of the electromagnetic pickup 8.

The adjusting unit is provided to reduce magnetic feedback by causing one induced electromotive force produced by magnetic flux from the adjusting unit and another induced electromotive force produced by magnetic flux from the driving coil of the electromagnetic driver 17 to negate each other in the string signal 10 detecting coil of the electromagnetic pickup 8. Also, the adjusting unit alters a tone color output from the electric stringed instrument by intentionally causing induced electromotive forces in the string signal detecting coil of the electromagnetic pickup 8 by providing magnetic flux emitted from the adjusting unit.

An electromagnetic driver 17 for sustaining the vibration of a string or a loudspeaker for outputting an amplified sound through an amplifier 18 that amplifies an output signal of the electromagnetic pickup 8 is used as the electromagnetic force producing unit. For example, an adjusting coil or an adjusting wire is used as the adjusting unit. An adjusting coil 30 is placed at a peripheral portion or an inside boundary portion or an inner portion of the string signal detecting coil of the electromagnetic pickup 8 wound in the shape of concentric circles, and also a nearly straight-line conductive wire is placed in the neighborhood of the string signal detecting coil. Further, a thin-film conductor having conductive unit on a base unit formed on a film can be used as the adjusting unit.

The adjusting unit is attached to, e.g., a cover of the string signal detecting coil, a bobbin of the string signal detecting coil, a fixture of the electromagnetic pickup, a body of the electric stringed instrument or a pick-guard placed in the neighborhood of the electromagnetic pickup.

According to the present invention, a signal from the electromagnetic pickup 8 is amplified by the amplifier 18 and thereafter flows through a driving coil of the electromagnetic force producing unit, e.g., the electromagnetic driver 17 in FIG. 3 for sustaining the vibration of a string. A part of a current flowing through the driving coil is fed back to the adjusting unit, e.g., an adjusting coil 30 in FIG. 3, and flux emitted from the adjusting coil 30 by the feedback operation described above and flux emitted from the 10 electromagnetic driver 17 negate each other in the electromagnetic pickup 8, and thereby high frequency noise is substantially eliminated.

Figure 4:
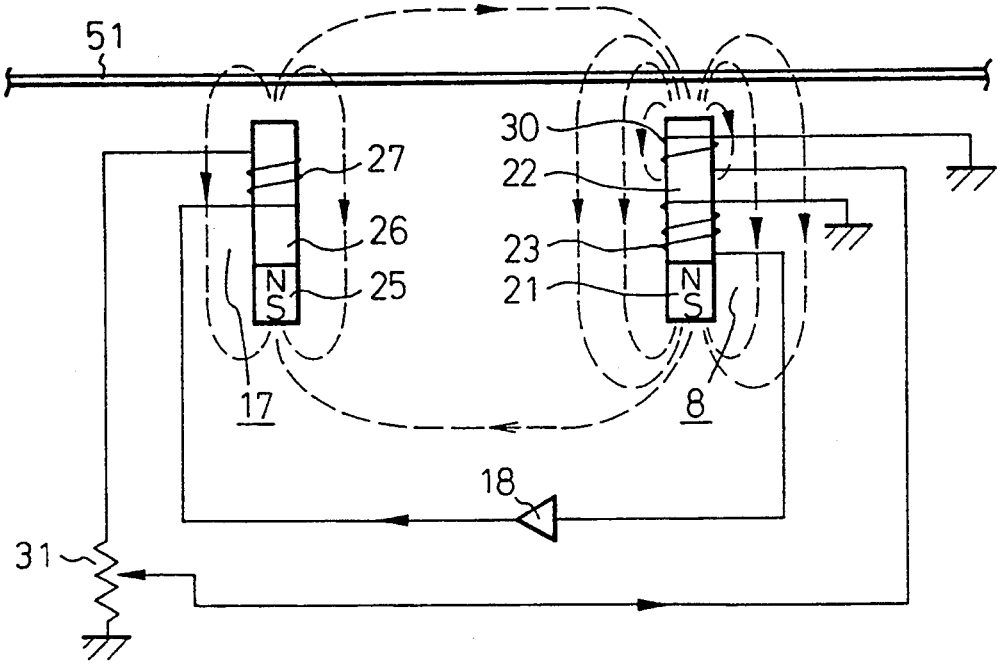
FIG. 4 is a schematic view for explaining magnetic feedback in a case that a magnetic flux producing unit is an electromagnetic driver.

In the following, a first preferred embodiment of an electric stringed instrument according to the present invention applied to an electric guitar is described with reference to accompanying drawings FIG. 3 and FIG. 4. Reference numeral 1 is an electric guitar. The electric guitar 1 has plural strings 51 and an electromagnetic pickup 8 is mounted on a body 2 of the electric guitar 1. The electromagnetic pickup 8 has a permanent magnet 21 and a pole piece 22 made of ferromagnetic material magnetically combined with the magnet 21. The pole piece 22 is wound with a string signal detecting coil 23 for detecting the vibration of a string 51. The string signal detecting coil 23 is wound with about 7,000 turns using an extra fine wire with a diameter of 0.06 mm. An output end of the string signal detecting coil 23 is provided to an amplifier 18 mounted in a guitar body 2 and an output terminal of the amplifier 18 is applied to an electromagnetic driver 17 as an electromagnetic force producing unit.

The electromagnetic driver 17 has a permanent magnet 25 and a pole piece 26 made of ferromagnetic material magnetically combined with the magnet 25. The pole piece 26 is wound with a driving coil 27 for emitting an electromagnetic energy to excite a string 51. The driving coil 27 is wound with about 200 turns, e.g., using a thick copper wire with a diameter of about 0.3 mm. Reference numeral 30 is an adjusting coil as an adjusting unit. The adjusting coil 30 is wound around the pole piece 22 of the electromagnetic pickup 8, e.g., using a thick copper wire with a diameter of about 0.3 mm. One end of the adjusting coil 30 is connected with the amplifier 18 through a variable resistor 31 to feed a part of a current flowing into a driving coil 27 of the electromagnetic driver 17 to the amplifier. Therefore, although the adjusting coil 30 is magnetically combined with the string signal detecting coil 23 by a coefficient of mutual inductance, the adjusting coil 30 and the string signal detecting coil 23 are electrically isolated from each other.

Next, the operation of the embodiment described above is explained. Magnetic flux formed by a permanent magnet 21 of an electromagnetic pickup 8 and a pole piece 22 magnetically combined with the magnet 21 is varied by plucking a string 51, the varied flux changes a magnetic flux density inside of the pole piece 22, and thereby an induced electromotive force is produced in the string signal detecting coil 23, and the induced electromotive force becomes a vibration signal of the string 51. The vibration signal of the string 51 is applied to the amplifier 18 and amplified by the amplifier 18, and thereafter the amplified signal is provided to an electromagnetic driver 17. The electromagnetic driver 17 emits magnetic energy, that is magnetic flux, from the driving coil 27 of the electromagnetic driver 17 so as to excite the string 51. Since the magnetic energy is too strong, a part of the magnetic energy is fed back to the electromagnetic pickup 8 so that it causes an extraneous driving signal in the electromagnetic pickup 8, that is, the so-called magnetic feedback as described above.

The adjusting coil 30 is arranged such that one induced electromotive force caused by magnetic flux from the adjusting coil 30 and another induced electromotive force caused by magnetic flux from the driving coil 27 negate each other in the string signal detecting coil 23. The adjusting coil 30 is connected to the amplifier 18 through a variable resistor 31 that feeds a part of a current flowing in the electromagnetic driver 17 to the adjusting coil 30 as a driving current for the adjusting coil 30 to emit magnetic flux when an amplified signal is provided to the electromagnetic driver 17. A polarity of magnetic flux emitted from the adjusting coil 30 is reversed from the polarity of the flux emitted from the electromagnetic driver 17 so that they negate each other in the electromagnetic pickup 8, and thereby the generation of noise by the magnetic feedback is prevented.

Also, the variable resistor 31 is used to properly adjust a quantity of magnetic flux emitted from the adjusting coil 30 so as to match the magnetic flux fed back from the electromagnetic driver 17 with the magnetic flux emitted from the adjusting coil 30. The resistance value of the variable resistor 31 is very small, for example about $0.1\omega$, relative to that of the electromagnetic driver 17, for example about $7\omega$, and so operation of the electromagnetic driver 17 as described above is not substantially affected by provision of the variable resistor 31. Further, since the adjusting coil 30 uses a relatively thick copper wire with a diameter of about 0.3 mm and the adjusting coil 30 is wound with about only one turn or a few turns, thus induced inductance and a phase shift between an applied voltage and an applied current provided to the adjusting coil 30 do not increase, and the variation of the current is coincident with that of magnetic flux emitted from the adjusting coil 30.

Figure 5:
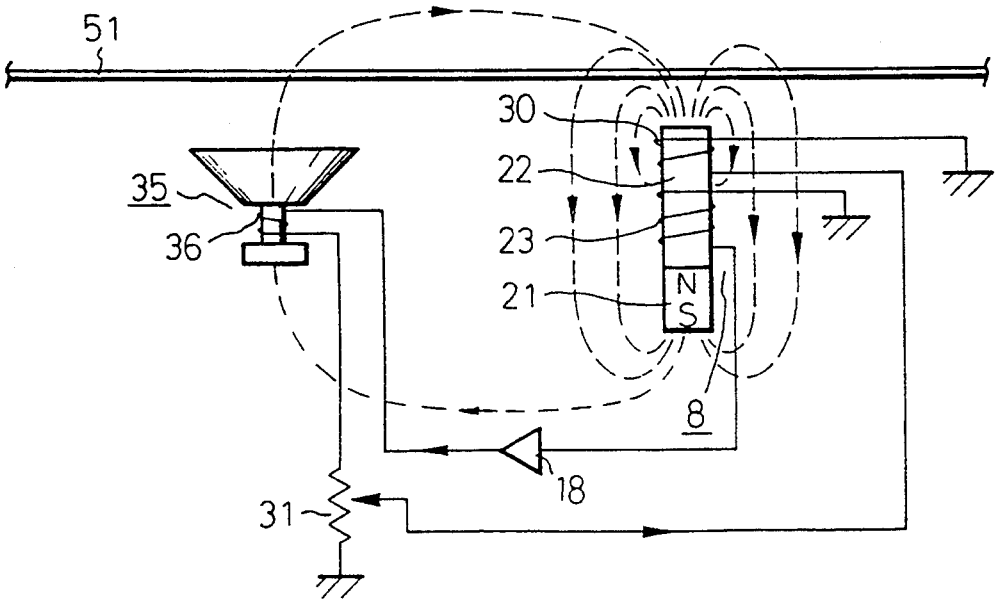
FIG. 5 is a schematic view for explaining magnetic feedback in a case that a magnetic flux producing unit is a loudspeaker.

Next, a second embodiment of the present invention applied to a loudspeaker as an electromagnetic unit is explained briefly with reference to FIG. 5. The same portions in FIG. 5 as in the first embodiment described above have the same numerals as the first embodiment so a description of those portions is omitted. In FIG. 5, reference numeral 35 is a loudspeaker. The loudspeaker 35 has a voice coil 36 and the voice coil 36 is connected to an amplifier 18.

The amplifier 18 outputs an amplified string vibration signal to the voice coil 18, and thereby the loudspeaker 35 outputs a music sound in accordance with an oscillation frequency of a string 51. However, at the same time, the voice coil 18 emits magnetic flux in the neighborhood of the voice coil 18 and the magnetic flux emitted from the voice coil 18 causes the magnetic feedback in an electromagnetic pickup 8 as described above. The remaining explanation of the second embodiment is the same that of the first embodiment as described above, and thus the explanation is omitted.

Next, several embodiments regarding an adjusting unit, which is a main part of an electric stringed instrument according to the present invention, are explained using examples applied to an electric guitar.

Figure 6:
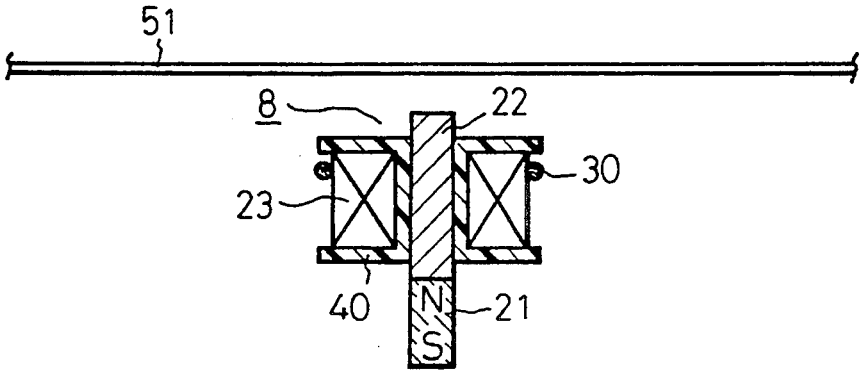
FIG. 6 is a schematic cross-sectional view of an embodiment according to the present invention using an adjusting coil as adjusting means placed at a peripheral portion of a string signal detecting coil wound in the shape of concentric circles.

FIG. 6 shows a schematic cross-sectional view of an embodiment using an adjusting coil 30 as an adjusting unit placed at a peripheral portion of a string signal detecting coil 23 of an electromagnetic pickup 8 wound in the shape of concentric circles. Reference numeral 40 is a bobbin around which is wound the string signal detecting coil 23.

Figure 7:
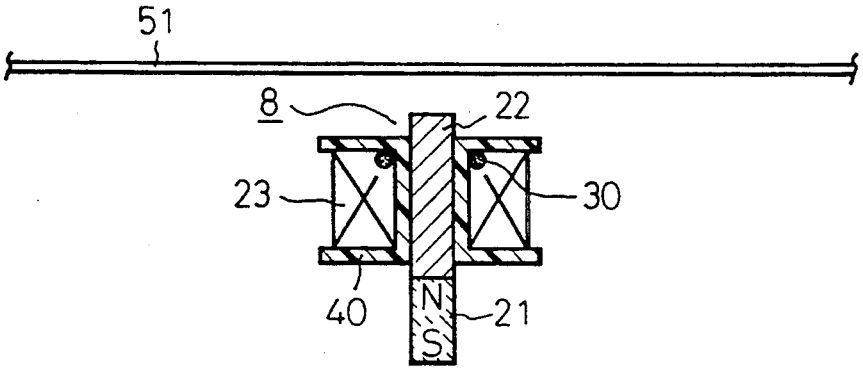
FIG. 7 is a schematic cross-sectional view of an embodiment according to the present invention using an adjusting coil as adjusting means placed at an inside boundary portion of a string signal detecting coil wound in the shape of concentric circles.

FIG. 7 is an embodiment of an adjusting coil 30 placed at an inside boundary portion of a string signal detecting coil 23 wound in the shape of concentric circles.

Figure 8:
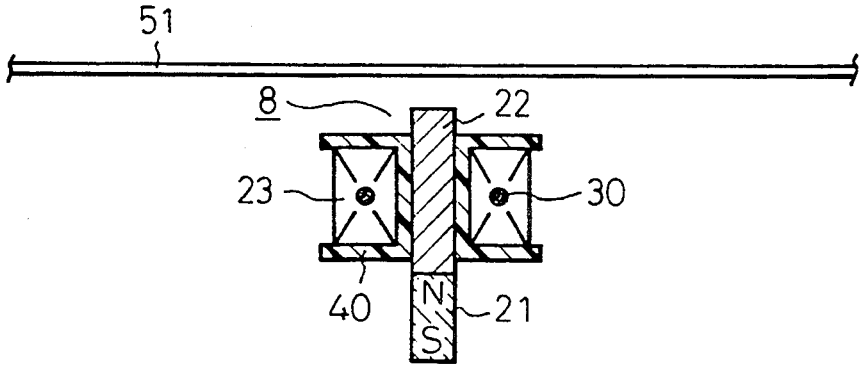
FIG. 8 is a schematic cross-sectional view of an embodiment according to the present invention using an adjusting coil as adjusting means placed at an inner portion of a string signal detecting coil wound in the shape of concentric circles.

FIG. 8 is an embodiment of an adjusting coil 30 placed at an inner portion of a string signal detecting coil 23.

Figure 9:
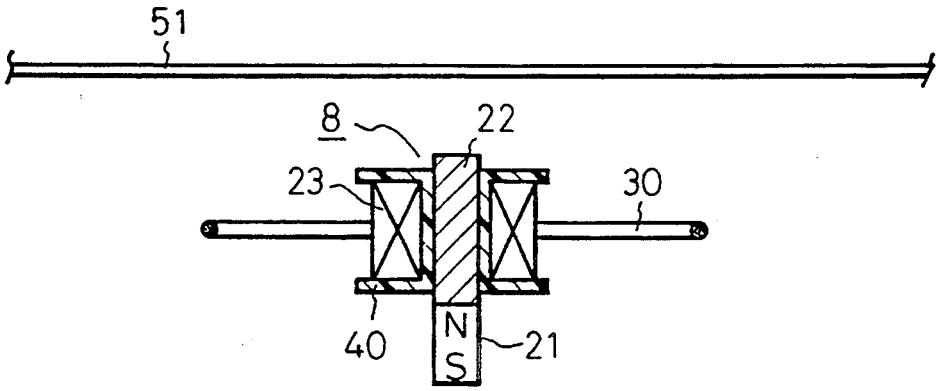
FIG. 9 is a schematic cross-sectional view of an embodiment according to the present invention using an adjusting coil as adjusting means placed at a position apart from a peripheral portion of a string signal detecting coil wound in the shape of concentric circles.

FIG. 9 is an embodiment of an adjusting coil 30 placed at a position apart from a peripheral portion of a string signal detecting coil 23.

Figure 10:
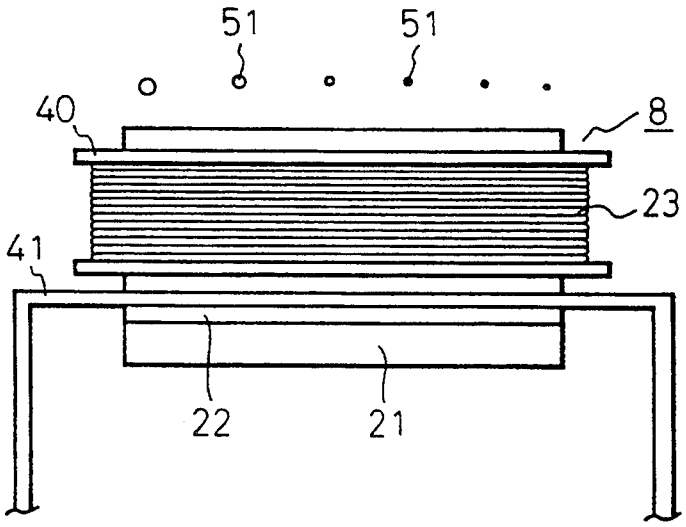
FIG. 10 is a schematic view of an embodiment according to the present invention using an adjusting wire forming a nearly straight-line as adjusting means placed in the neighborhood of a string signal detecting coil.

FIG. 10 is an embodiment using an adjusting wire forming nearly a straight-line as an adjusting unit placed in the neighborhood of a string signal detecting coil 23.

Figure 11:
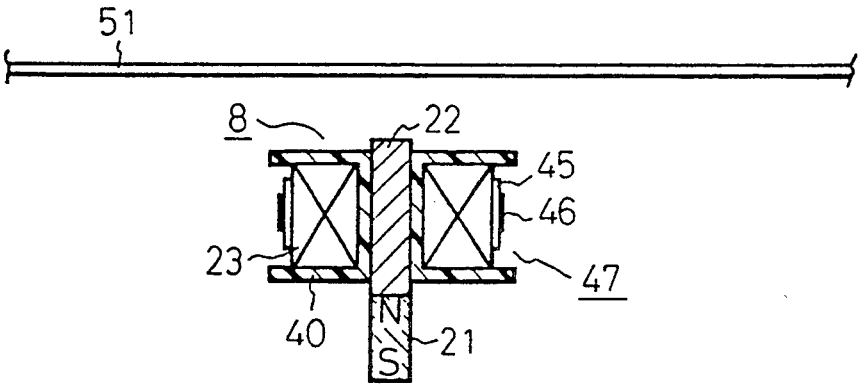
FIG. 11 is a schematic cross-sectional view of an embodiment according to the present invention using a thin-film conductor as adjusting means adhered to a peripheral portion of a string signal detecting coil.

FIG. 11 is an embodiment using a thin-film conductor 47 as an adjusting unit having conductive materials 46 on a base unit 45 adhered to a peripheral portion of a string signal detecting coil 23.

Figure 12:
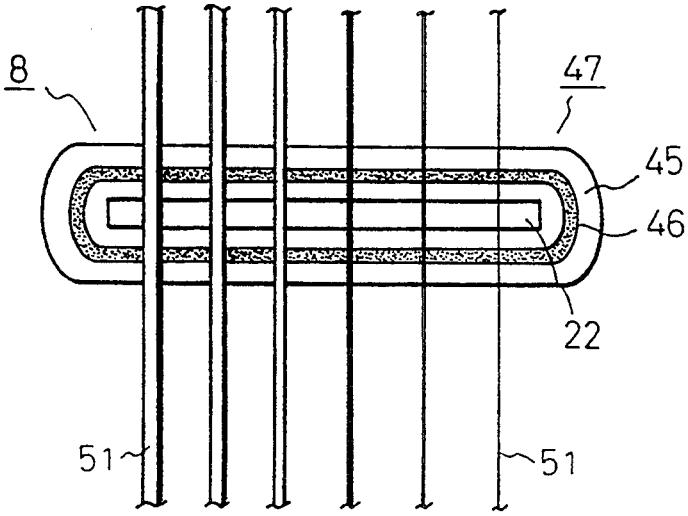
FIG. 12 is a schematic top view of an embodiment according to the present invention using a thin-film conductor as adjusting means adhered on top of a string signal detecting coil.

FIG. 12 is an embodiment of the thin-film conductor 47 adhered on top of an electromagnetic pickup 8.

Figure 13:
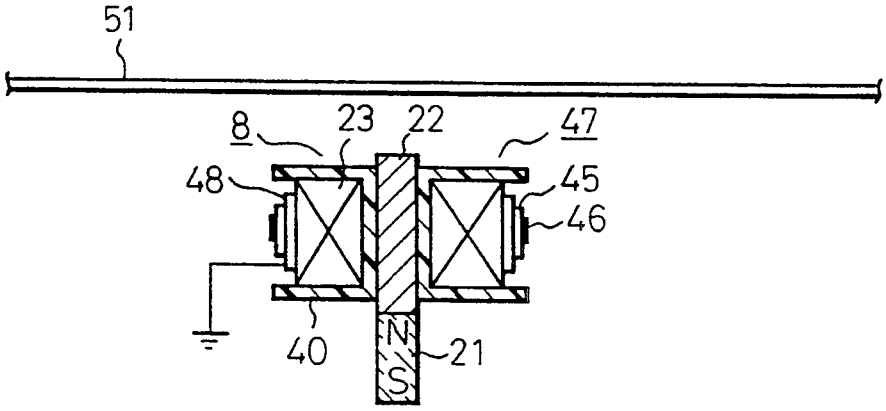
FIG. 13 is a schematic cross-sectional view of an embodiment according to the present invention using a thin-film conductor and a conductive grounding unit as adjusting means adhered to a peripheral portion of a string signal detecting coil.

FIG. 13 is an embodiment of the thin-film conductor 47 described above further having a conductive grounding unit 48 that reduces an electrostatic coupling between the conductive unit 46 on a base unit 45 and the string signal detecting coil 23 so that a leakage signal from the conductive unit 46 in which a large signal flows to the string signal detecting coil 23 through a parasitic capacitance between them is greatly reduced. The conductive grounding unit 48 may be arranged between the adjusting coil 30 described above and the string signal detecting coil 23.

In the embodiments as described above, as an example, an electromagnetic pickup that has a magnet and a pole piece magnetically combined with the magnet is shown, however the electromagnetic pickup in the present invention is not limited by the type of electromagnetic pickup shown in the drawings and thus the electromagnetic pickup may be a type using a pole piece that is itself made of a magnet. Also, a single coil type pickup as shown in FIG. 2(*a*) is used as an example in the embodiments, but a double coil type pickup as shown in FIG. 2(*b*) may be used in the embodiments, and in the latter case an adjusting unit as described above may be placed around either of string signal detecting coils or both of the string signal detecting coils, and either case described above functions well as the adjusting unit. Further, regarding a variable resistor for adjusting an emission of magnetic flux, a fixed resistor may be used instead of the variable resistor if the value of resistance is found in advance or the variable resistor may be omitted in certain cases, and also the variable resistor may be formed by a selecting a type of resistor that is used by selecting one resistor out of plural resistors.

As described above, in an electric stringed instrument according to the present invention a polarity of magnetic flux emitted from an adjusting coil is in reverse polarity of flux emitted from an electromagnetic driver so that both negate each other in an electromagnetic pickup, and thereby the generation of high frequency noise caused by magnetic feedback is prevented, and the electric stringed instrument can be comfortably used.

Further, since an adjusting unit has a relatively thick copper wire and an adjusting coil is wound with about only one turn or a few turns so that an increase of induced inductance is prevented, magnetic flux can be produced without a phase lag and waveform distortion by an applied voltage and current provided to the adjusting unit so as to prevent the generation of a high frequency noise caused by magnetic feedback. Also, since the adjusting coil unit is wound with about only one turn or a few turns, a conventional pickup can be used by adding only a simple process and almost without alteration of a size and a shape of the pickup. The variable resistor to properly adjust a quantity of magnetic flux emitted from the adjusting unit can easily compensate for a difference in a distance between an electromagnetic force producing unit and an electromagnetic pickup, a quantity of magnetic flux emitted from the electromagnetic force producing unit and can compensate for each individual product. Further, a value of resistance of the variable resistor is very small, for example about 0.1ω, relative to that of an electromagnetic driver, for example about 7–8 ohms, so that operation of the electromagnetic driver is not substantially affected by provision of the variable resistor.

Also, the adjusting unit formed with a thin-film conductor having a conductive unit on a base unit formed on a film as shown in FIG. 11 and FIG. 12 is simply adhered to an electromagnetic pickup and so can be easily applied to an electromagnetic pickup, and further a conductive grounding unit as shown in FIG. 13 reduces an electrostatic coupling between the conductive unit on a base unit and the string signal detecting coil.

Furthermore, although not shown in the accompanying drawings, an electric guitar can be provided with a housing for an electromagnetic pickup, a cover or a bobbin for a string signal detecting coil, and a mount for attaching a pickup or a pick-guard, etc. An adjusting unit according to the present invention is formed by using a coil with very few windings or a wire with a diameter of about 0.3 mm, therefore the adjusting unit can be cheaply and inconspicuously arranged.

I claim:

1. An electric stringed instrument, comprising;

an electromagnetic pickup positioned on the instrument, said pickup having a permanent magnet and a string signal detecting coil wound around the permanent magnet and magnetically combined with the permanent magnet, an electromagnetic force producing means for producing an electromagnetic force, being positioned close to the electromagnetic pickup, and having a driving coil, an adjusting means for reducing magnetic feedback and for receiving a part of a current flowing in the driving coil of the electromagnetic force producing means and being positioned so that it is magnetically combined with the string signal detecting coil of the electromagnetic pickup, so that a first induced electromagnetic force caused by magnetic flux from said adjusting means and second induced electromotive force caused by magnetic flux from said driving coil negate each other in said string signal detecting coil.

2. An electric stringed instrument comprising;

an electromagnetic pickup positioned on the instrument, said pickup having a permanent magnet and a string signal detecting coil wound around the permanent magnet and magnetically combined with the permanent magnet, an electromagnetic force producing means for producing an electromagnetic force, being positioned close to the electromagnetic pickup, and having a driving coil, an adjusting means for reducing magnetic feedback and for receiving a part of a current flowing in the driving coil of the electromagnetic force producing means and being positioned so that it is magnetically combined with the string signal detecting coil of the electromagnetic pickup, so that said adjusting means alters a tone color output from the electric stringed instrument by causing induced electromotive forces to be produced in said string signal detecting coil by magnetic flux produced by said adjusting means.

3. An electric stringed instrument as set forth in claim 1 or 3 wherein said electromagnetic force producing means is an electromagnetic driver for sustaining the vibration of a string.

4. An electric stringed instrument as set forth in claim 1 or 2 wherein said electromagnetic force producing means is a loudspeaker for outputting an amplified sound through an amplifier for amplifying an output signal of said electromagnetic pickup.

5. An electric stringed instrument as set forth in claim 1 or 2 wherein said adjusting means is an adjusting coil.

6. An electric stringed instrument as set forth in claim 5 wherein said adjusting coil is placed at a peripheral portion of said string signal detecting coil wound in the shape of concentric circles.

7. An electric stringed instrument as set forth in claim 5 wherein said adjusting coil is placed at a peripheral portion of said string signal detecting coil wound in the shape of concentric circles and further a conductive grounding unit is placed between said adjusting coil and said string signal detecting coil.

8. An electric stringed instrument as set forth in claim 5 wherein said adjusting coil is placed at an inside boundary portion of said string signal detecting coil wound in the shape of concentric circles.

9. An fan electric stringed instrument as set forth in claim 5 wherein said adjusting coil is placed at an inner portion of said string signal detecting coil wound in the shape of concentric circles.

10. An electric stringed instrument as set forth in claim 1 or 2 wherein said adjusting means is an adjusting wire.

11. An electric stringed instrument as set forth in claim 10 wherein said adjusting wire is a substantially straight-line conductive wire positioned close to said string signal detecting coil.

12. An electric stringed instrument as set forth in claim 1 or 2 wherein said adjusting means is a thin-film conductor having a conductive unit on a base unit formed on a film.

13. An electric stringed instrument as set forth in claim 12 wherein said thin-film conductor further has a conductive grounding unit placed between said base unit and said string signal detecting coil.

14. An electric stringed instrument as set forth in claim 1 or 2 wherein said adjusting means is positioned at a predetermined place on the electric stringed instrument.

15. An electric stringed instrument as set forth in claim 14 wherein said predetermined place is a cover of said string signal detecting coil.

16. An electric stringed instrument as set forth in claim 14 wherein said predetermined place is a bobbin of said string signal detecting coil.

17. An electric stringed instrument as set forth in claim 14 wherein said predetermined place is a fixture of said electromagnetic pickup.

18. An electric stringed instrument as set forth in claim 14 predetermined place is a body of said electric stringed instrument.

19. An electric stringed instrument as set forth in claim 14 wherein said predetermined place is a pickguard placed close to said electromagnetic pickup.

* * * * *

UNITED STATES PATENT AND TRADEMARK OFFICE

CERTIFICATE OF CORRECTION

PATENT NO. : 5,378,850

DATED : January 3, 1995

INVENTOR(S) : Kenji Tumura

It is certified that error appears in the above-indentified patent and that said Letters Patent is hereby corrected as shown below:

Claim 3, Col. 11, line 23, "3" to --2--.

Claim 9, Col. 12, line 5, delete "fan".

Claim 18, Col. 12, line 38 before "predetermined" insert --wherein said--.

Signed and Sealed this

Thirtieth Day of May, 1995

*Attest:*

*Attesting Officer*

Bruce Lehman

BRUCE LEHMAN

*Commissioner of Patents and Trademarks*